US008408244B2

(12) United States Patent
Gilcher

(10) Patent No.: US 8,408,244 B2
(45) Date of Patent: Apr. 2, 2013

(54) SANITARY INSTALLATION PART

(75) Inventor: Manfred Gilcher, Neuenburg (DE)

(73) Assignee: Neoperl GmbH, Mullheim (DE)

( * ) Notice: Subject to any disclaimer, the term of this patent is extended or adjusted under 35 U.S.C. 154(b) by 815 days.

(21) Appl. No.: 12/089,549

(22) PCT Filed: Aug. 11, 2006

(86) PCT No.: PCT/EP2006/007967
§ 371 (c)(1),
(2), (4) Date: Apr. 8, 2008

(87) PCT Pub. No.: WO2007/042100
PCT Pub. Date: Apr. 19, 2007

(65) Prior Publication Data

US 2008/0210310 A1 Sep. 4, 2008

(30) Foreign Application Priority Data

Oct. 13, 2005 (DE) ..... 20 2005 016 046 U

(51) Int. Cl.
*F16K 15/02* (2006.01)

(52) U.S. Cl. ..... 137/511; 137/540; 137/454.2; 137/542

(58) Field of Classification Search ..... 137/511, 137/543, 543.13, 543.15, 543.21, 536, 540, 137/454.2, 542
See application file for complete search history.

(56) References Cited

U.S. PATENT DOCUMENTS

| | | | | |
|---|---|---|---|---|
| 4,527,593 | A * | 7/1985 | Campau | 137/805 |
| 4,862,913 | A * | 9/1989 | Wildfang | 137/543 |
| 5,090,442 | A * | 2/1992 | Campau | 137/315.01 |
| 5,195,552 | A * | 3/1993 | Nehm | 137/269 |
| 5,370,150 | A * | 12/1994 | Nehm | 137/454.2 |
| 5,743,291 | A * | 4/1998 | Nehm et al. | 137/454.2 |
| 6,837,267 | B2 * | 1/2005 | Weis et al. | 137/542 |
| 7,143,784 | B2 * | 12/2006 | Fangmeier et al. | 137/542 |
| 7,178,784 | B2 * | 2/2007 | Flynn | 251/149.6 |
| 7,389,791 | B2 * | 6/2008 | Fangmeier | 137/493.9 |
| 7,431,048 | B2 * | 10/2008 | Fangmeier | 137/542 |
| 2004/0074539 | A1 * | 4/2004 | Weis et al. | 137/543 |

FOREIGN PATENT DOCUMENTS

| | | |
|---|---|---|
| DE | 3817270 | 11/1989 |
| DE | 3820837 | 1/1990 |
| DE | 9317654 | 4/1994 |
| DE | 29721732 | 3/1998 |
| DE | 19835788 | 3/2000 |
| DE | 20303522 | 7/2003 |
| EP | 0190965 | 8/1986 |

* cited by examiner

*Primary Examiner* — Kevin Lee
*Assistant Examiner* — Macade Brown
(74) *Attorney, Agent, or Firm* — Volpe and Koenig, P.C.

(57) ABSTRACT

A sanitary installation part (1) which has an installation housing (2) which can be inserted into a housing mount of a gas line or a liquid line is provided and has at least one latching element which projects into a latching position on the outer circumference of the housing and can be moved in a resiliently elastic manner from this latching position to a zero position. The installation part according to the invention provides that the at least one latching element is designed as a latching protuberance (5) which is beveled or rounded along its transverse edges oriented transversely to the insertion direction on both sides, and the at least one latching protuberance (5), in its zero position, can be can be resiliently fitted into the latching element mount, in which the latching protuberance (5) is incorporated in the outer circumference of the installation housing (2).

10 Claims, 7 Drawing Sheets

SANITARY INSTALLATION PART

BACKGROUND

The invention relates to a sanitary installation part comprising an installation housing or an installation cage, which can be inserted into a housing or cage mount of a gas line or liquid line and is provided with at least one latching element projecting from the outer housing or cage circumference in a latched position and which can be deflected from this latching position into a zero position in a resiliently-elastic fashion.

A sanitary installation part embodied as a backflow preventer is already known having an installation housing, which installation housing can be inserted into a water line. On this installation housing several latching elements are provided, evenly distributed in the circumferential direction, which are embodied as an outwardly angled spring arm. In order to enable the installation housing to be inserted into the housing mount the spring arms are temporarily mobile from their latching position into a zero position, until the spring arms can resiliently return to the latching position. In the latching position the spring arms of the known backflow preventer project from the installation housing such that they can engage a latching groove at the clear inner circumference of the housing mount. As soon as the spring arms have moved into the latching groove of the housing mount in a resiliently-elastic fashion only a destructive removal of the known backflow preventer is possible.

The angle of the spring arms actually predetermines the direction of inserting the known backflow preventer. If the known backflow preventer is to be inserted into the housing mount against the angle of its spring arms, a housing mount with a relatively large circumferential insertion incline is necessary, which can quite considerably enlarge the dimensions of the housing mount in the longitudinal direction.

SUMMARY

Therefore, the object is to provide a sanitary installation part of the type mentioned at the outset which allows an assembly of the installation part according to the invention optionally in or against the direction of flow and which allows the installation in a housing mount optionally with or without a latching groove or a similar counter latching element.

The solution of the object according to the invention particularly comprises that at least one latching element is embodied as a latching protuberance, and that at least one latching protuberance can be elastically deflected from its zero position into a latching element mount, in which the latching protuberance engages the outer circumference of the installation housing or the installation cage.

The installation part according to the invention is provided with at least one latching element embodied as a latching protuberance. Due to the fact that the latching protuberance allows a displacement of the installation part in or against the direction of flow the installation part according to the invention can optionally be inserted into the housing or cage mount of the sanitary supply line not only with one or the other face first, rather a simple or destruction-free dismantling of the installation part according to the invention is facilitated. Due to the fact that in the zero position, the latching protuberances of the installation part according to the invention can be resiliently deflected into the latching element mount in which the latching protuberances insert into the outer circumference of the installation housing or installation cage the installation part according to the invention can be inserted into a housing or cage mount provided without any counter latching element such that the latching protuberances remain in their zero position. The installation part according to the invention can therefore be inserted into a housing or cage mount optionally with or without latching grooves or similar counter latching elements.

In order to facilitate the insertion of the installation part according to the invention in or against the direction of flow, it is beneficial for the latching protuberances to be rounded or beveled along their transverse edges oriented transversely in reference to the insertion direction at both sides.

Here, a preferred further development according to the invention provides that the latching element mount is embodied as a slot open at the facial edge, which separates the installation housing or the installation cage from at least one spring arm, each carrying one latching protuberance.

The installation part according to the invention can also be inserted in a housing or cage mount not provided with a latching groove or a similar counter latching element. Here, the installation part can be inserted into the housing or cage mount such that at least one latching element remains in the zero position.

However, an embodiment is preferred in which the installation part according to the invention is inserted in a housing or cage mount, which housing or cage mount being provided with a latching groove or a similar latching recess cooperating with the latching protuberances. Here, in its latching position, the latching protuberance can engage a latching groove or a similar latching recess at the clear inner circumference of the housing or cage mount.

A particular advantage of the installation part according to the invention is the fact that the installation part can be inserted optionally in a housing or cage mount with or without a latching groove or a latching recess. Another advantage of the installation part according to the invention comprises that the installation part can optionally be inserted into the housing or cage mount of the sanitary supply line with one or the other face of its mounting housing or installation cage first.

It can be beneficial for the slot to have a sufficient slot width to allow a resilient engagement of the latching protuberance into the outer circumference of the mounting housing or installation cage.

A preferred application field of the installation part according to the invention provides for the installation part to be embodied as a backflow preventer.

BRIEF DESCRIPTION OF THE DRAWINGS

Additional features of the invention are discernible from the following description of an exemplary embodiment according to the invention in connection with the claims and the drawing. In the following the invention is illustrated using a preferred exemplary embodiment.

Shown are.

DETAILED DESCRIPTION OF THE PREFERRED EMBODIMENTS

Figure 1:
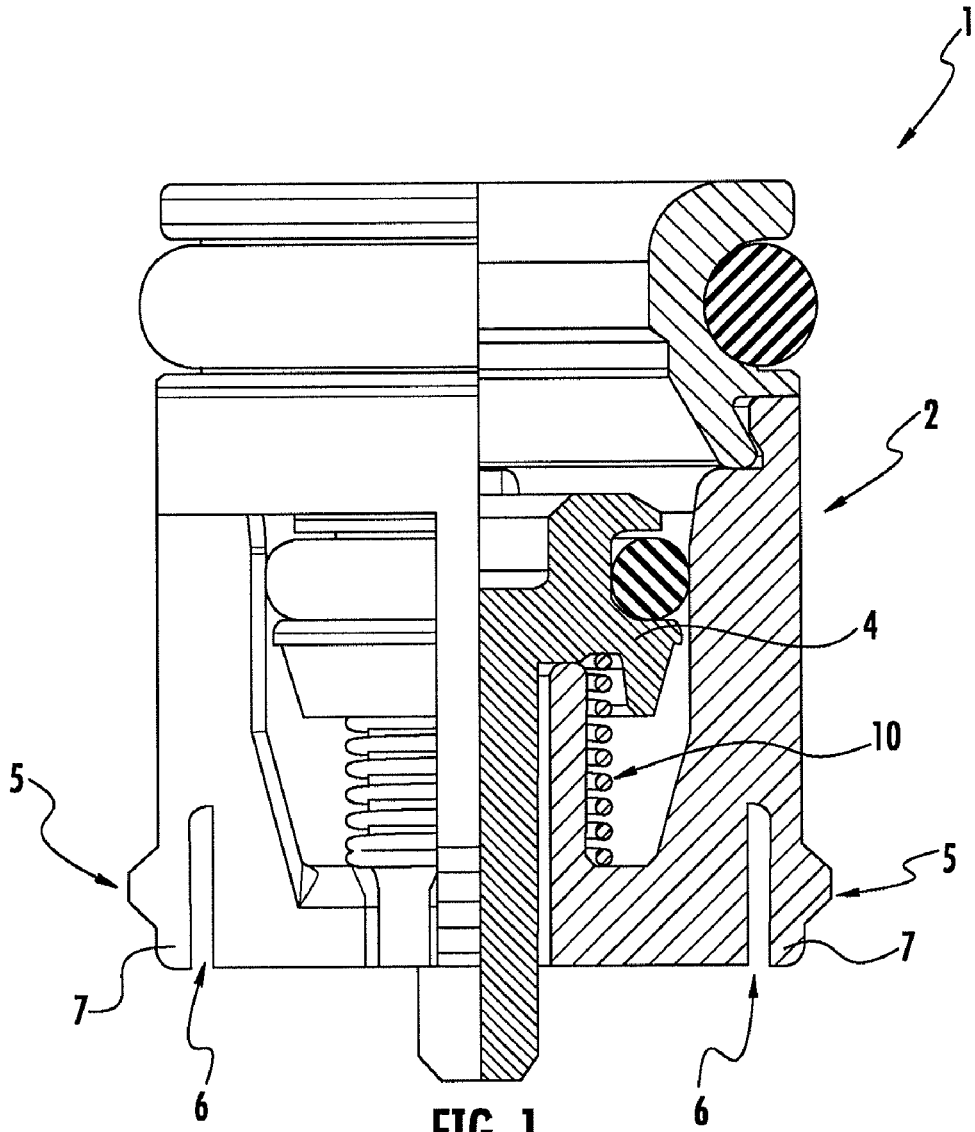
FIG. 1 is a partial longitudinal cross-sectional view sanitary installation part embodied as a backflow preventer.
Figure 2:
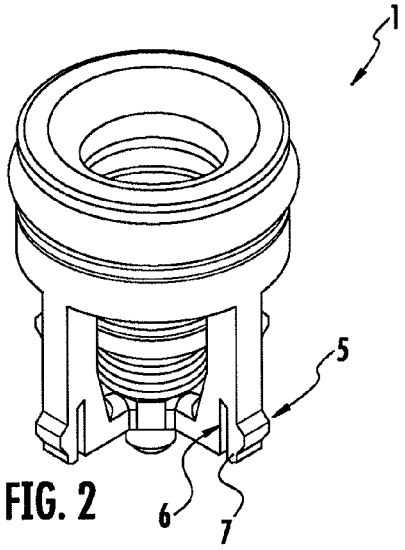
FIGS. 2 to 4 are various perspective views of the installation part of FIG. 1.
Figure 3:
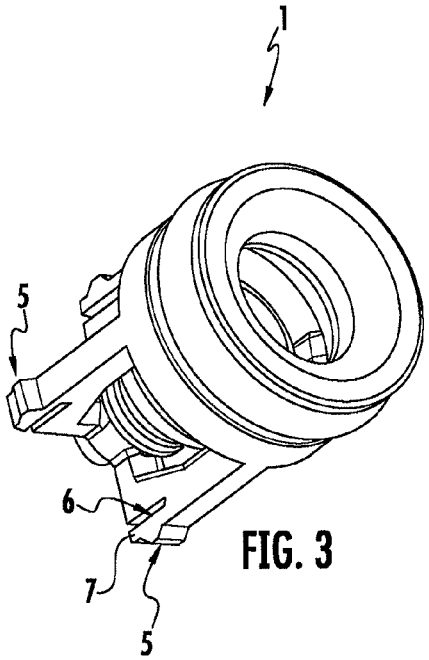
Figure 4:
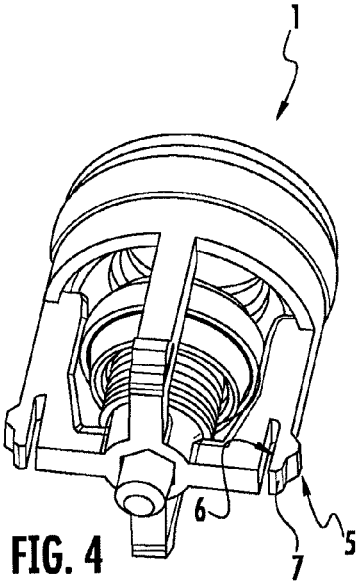

FIGS. 1 through 4 show a sanitary installation part which is here embodied as a backflow preventer 1. The backflow preventer 1 is provided with an installation housing 2, embodied as a housing cage in a downstream partial section. The backflow preventer 1 with its installation housing 2 can be inserted into a housing mount 3 of a gas or liquid line not shown in greater detail, here. The backflow preventer 1 has a valve body 4, guided in a displaceable manner in the installation housing 2, which can be moved under the pressure of the inflowing liquid from a closed position into an open position against the retention force of a return spring 10. In an undesired backflow of the liquid the valve body 4 is pressed against the valve seat in the installation housing 2 such that the backflow movement of the liquid stops at the backflow preventer 1.

Comparing the FIGS. 1 through 4 illustrates that the backflow preventer 1 is provided with several latching elements, which are each embodied as a latching protuberance 5, rounded or beveled at their transverse edges at both sides oriented transversely in reference to the installation direction. In FIGS. 1 through 4 it is discernible that these latching protuberances 5 here project from the housing circumference in the latching position shown and can be moved from this latching position into a zero position closer to the mounting housing 2 in a resiliently-elastic fashion. In this zero position the latching protuberances 5 can be resiliently deflected into a latching element mount such that the latching protuberances 5 insert the outer circumference of the mounting housing 2.

From FIG. 1 it is discernible that the latching element mounts are embodied as a slot 6, open at the edge of the face, which separates the installation housing 2 from a spring arm 7 carrying one latching protuberance 5 each.

Figure 5:
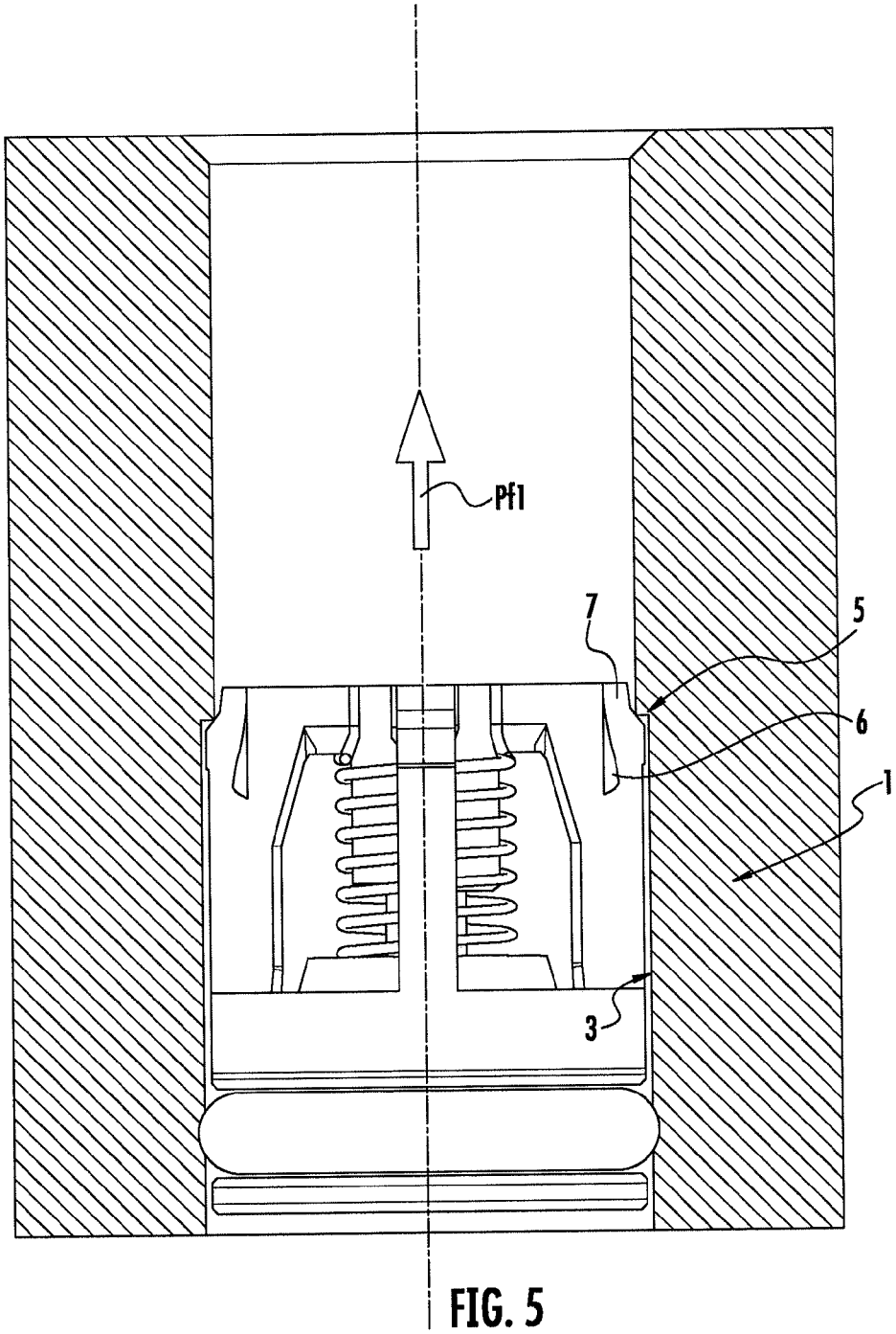
FIG. 5 is a view of the installation part inserted in a sanitary supply line from FIGS. 1 through 4, with the installation part being inserted in the direction of flow in a housing mount of the sanitary supply line not provided with a counter latching means.
Figure 6:
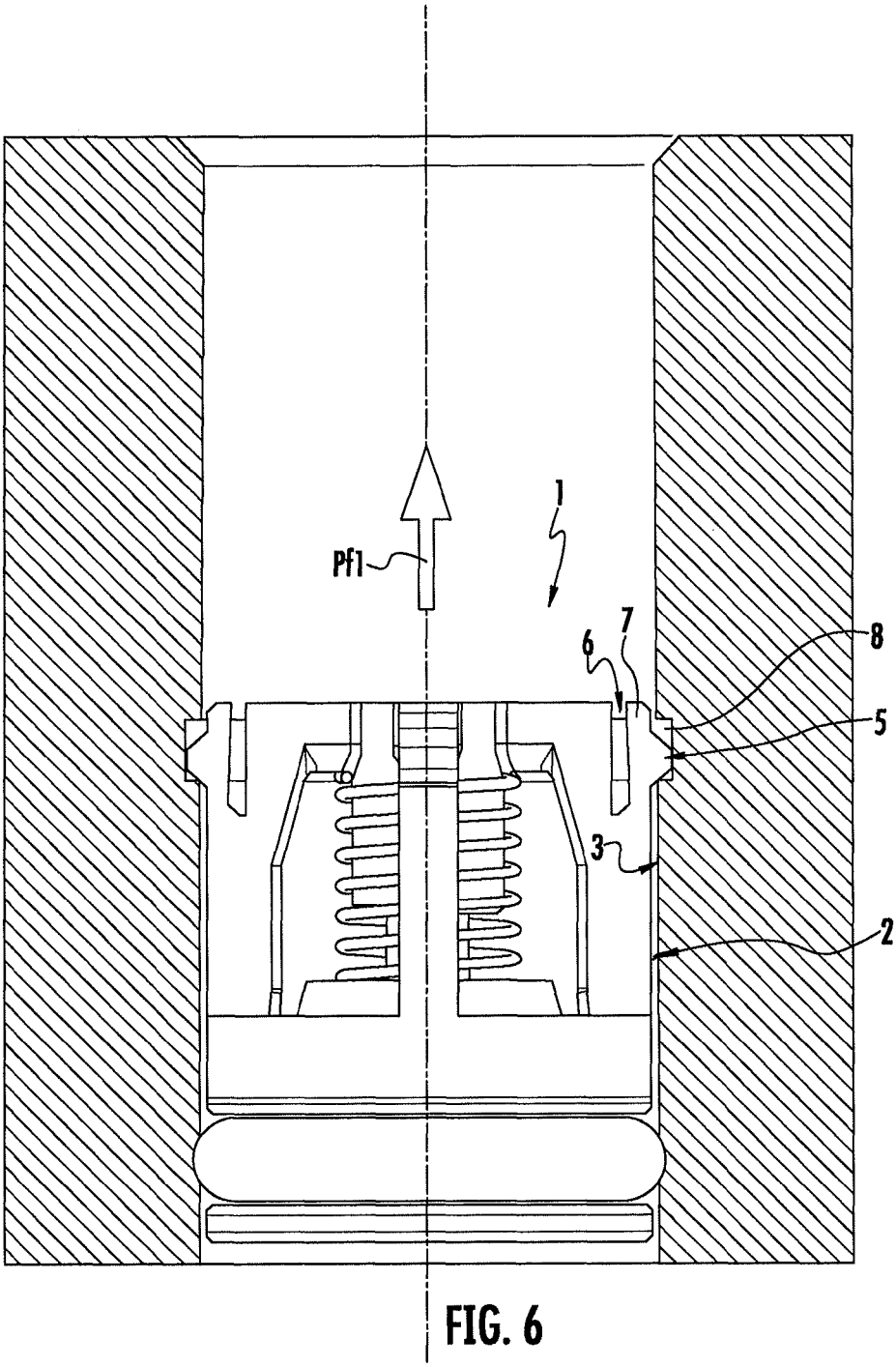
FIG. 6 is a view of the installation part according to FIGS. 1 through 5, with the housing mount of the sanitary supply line here being provided with a circumferential latching groove downstream, which the latching protuberances engage, which are provided at the outer circumference of the installation part, FIG. 7 a view of the installation part according to FIGS. 1 through 6, with the installation part here being inserted against the direction of flow in a housing mount not provided with a counter latching element, with its mounting opening can be sectionally closed after the insertion of the installation part.

As discernible from FIGS. 5 and 6, the backflow preventer 1 can be inserted into the housing mount 3 with its downstream face first in the direction of flow Pf1. However, in FIGS. 7 and 8 it is illustrated that the backflow preventer 1 can also be inserted into the housing mount 3 of the sanitary supply line with its inflowing face first against the direction of flow Pf1. The backflow preventer 1 can therefore optionally be inserted first into the housing or cage mount 3 with one or the other face of its installation housing 2 or the installation cage.

Figure 7:
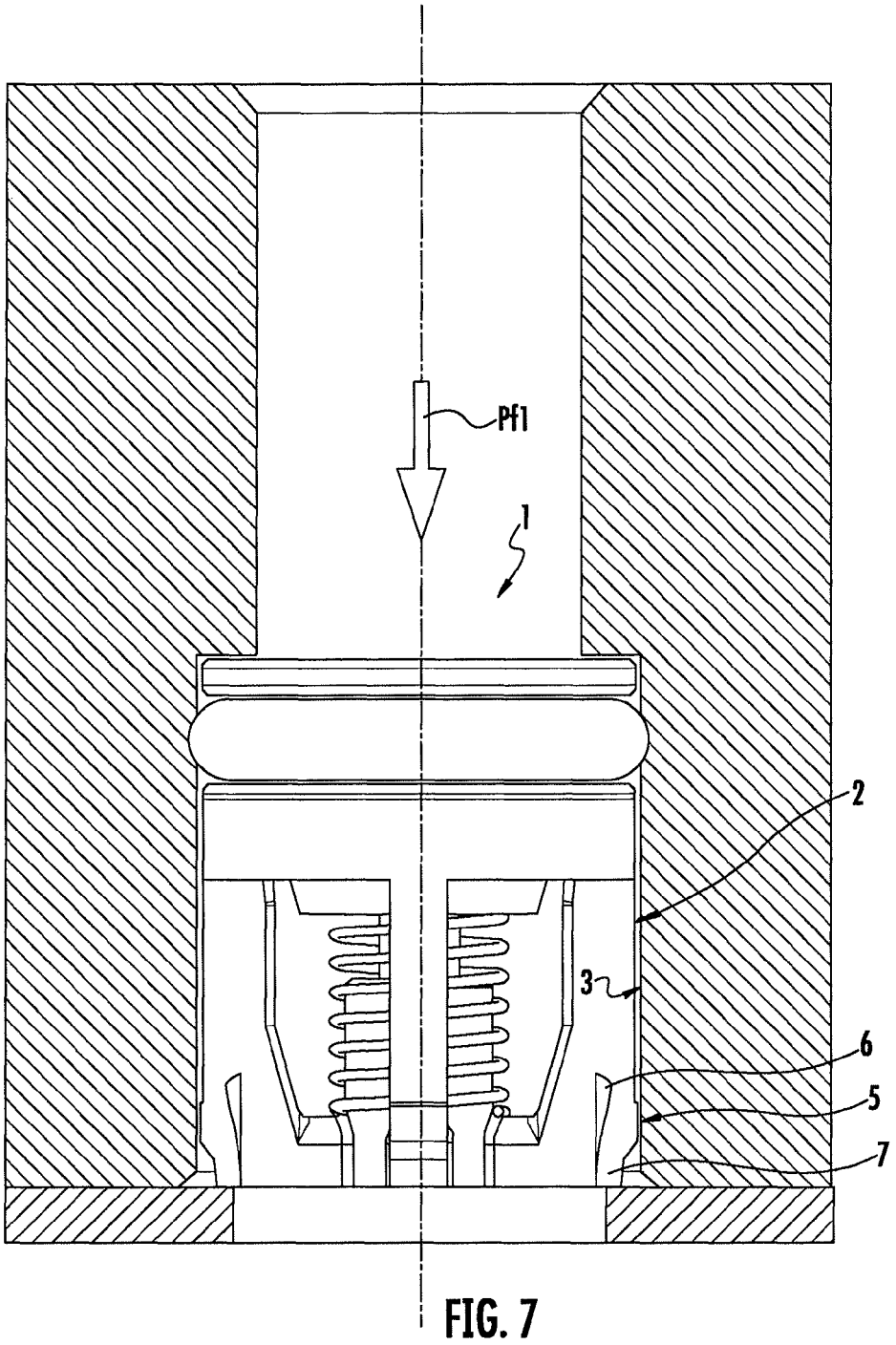
Figure 8:
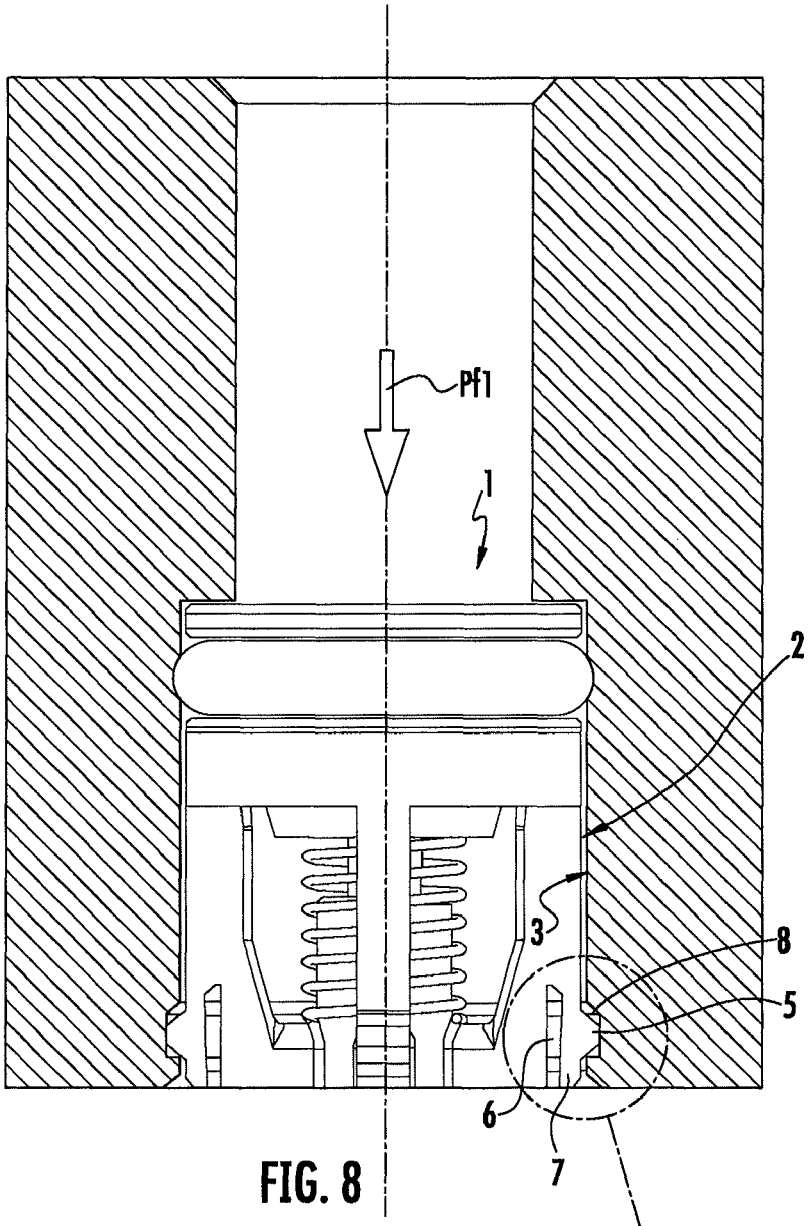
FIG. 8 is a view of the installation part according to FIGS. 1 through 7, with the installation part being inserted against the direction of flow in a housing mount provided with a latching groove downstream.
Figure 9:
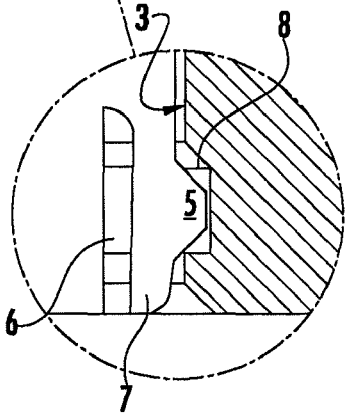
FIG. 9 is a view of the installation part already shown in FIG. 8 in a detailed illustration in the area of the latching protuberance.

From the comparison of the FIGS. 5 and 7, on the one hand, and the FIGS. 6 and 8, on the other hand, it is discernible that the installation part embodied as a backflow preventer 1 can optionally be inserted into a housing mount or a cage mount with or without a latching groove 8 or a similar latching mount. In FIGS. 5 and 7 the backflow preventer 1 is inserted in a housing mount 3 without a latching groove or a similar counter latching element such that the latching protuberances 5 remain in their elastic zero position.

However, the housing mounts 3 shown in FIGS. 6 and 8 are provided upstream (FIG. 6) and/or downstream (FIG. 8) with a groove 8, into which the latching protuberances 5 can resiliently deflect in their latching position.

Due to the fact that the latching means provided at the backflow preventer 1 are embodied as latching protuberances rounded or beveled at both sides these latching protuberances do not prevent any displacement of the backflow preventer 1 in or against the direction of flow Pf1 as soon as the latching resistance has been overcome. Due to the fact that the latching protuberances 5 allow a displacement of the backflow preventer 1 in or against the direction of flow Pf1, the backflow preventer 1 can be inserted into a housing mount 3 not only optionally with one or the other face first, rather a simple and destruction-free disassembly of the backflow preventer 1 is also facilitated. Due to the fact that in the zero position the latching protuberances 5 of the backflow preventer 1 can be resiliently deflected into a latching element mount in which the latching protuberances insert into the outer circumference of the mounting housing 2, the backflow preventer 1 can also be inserted in a housing mount not provided with a counter latching element such that the latching protuberances 5 remain in their zero position. The backflow preventer 1 can therefore optionally be inserted into a housing mount 3 with or without a latching groove 8 or a similar counter latching element.

Figure 10:
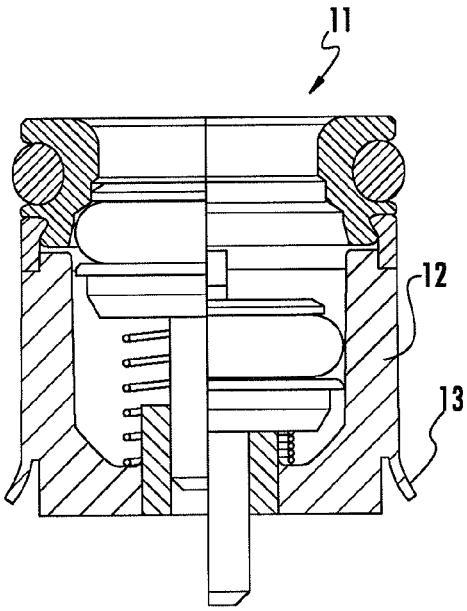
FIGS. 10 and 11 are views of installation parts embodied according to prior art and as backflow preventers in a longitudinal cross-section, with the longitudinal cross-section according to FIGS. 10 and 11 showing the known installation parts in their closed position and in their open position.
Figure 11:
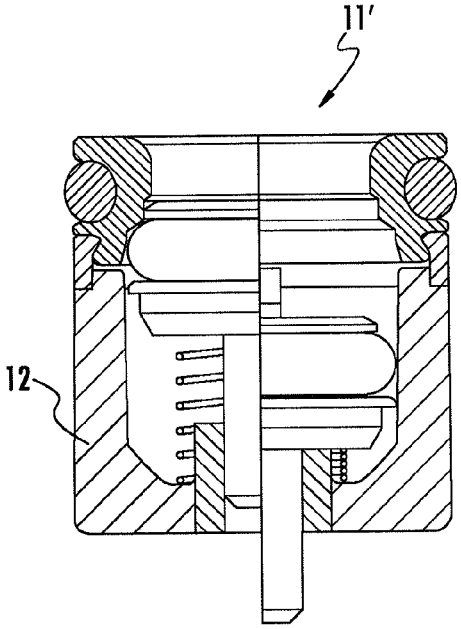

FIGS. 10 and 11 show a backflow preventer 11 according to prior art. The known backflow preventer 11 with its installation housing 12 can be inserted into a water line. At this installation housing 12 several latching elements are provided, evenly distributed in the circumferential direction, which are embodied as spring arms 13 angled outwardly. In a latching position the spring arms 13 of the previously known backflow preventer 11 protrude from the installation housing 12 such that they can engage a latching groove at the clear inner circumference of the housing mount. In order to allow for the installation housing 12 to be inserted into the housing mount the spring arms 13 of the known backflow preventer 11 are temporarily movable from their latching position into a zero position until the spring arms 13 can resiliently move back into the latching position. As soon as the spring arms 13 are resiliently deflect into the latching groove of the housing mount only a destructive removal of the previously known backflow preventer 11 is possible. The angle of the spring arm 13 per se determines the inserting direction of the known backflow preventer 11; when the known backflow preventer shall be inserted into the housing mount 3 against the angle of its spring arms 13, a housing mount with a relatively large circumferential insertion incline is necessary, which can considerably increase the dimensions of the housing mount in the longitudinal direction and in the diameter. If such a long insertion incline in the sanitary supply line cannot be implemented another also known backflow preventer 11' must be used, with its installation housing not being provided with any spring latches 13 or similar latching element.

The invention claimed is:

1. A sanitary installation part (1) comprising an installation housing (2) or installation cage, which can be mounted in an outer housing or a cage mount (3) of a gas or liquid line, the installation housing (2) includes a plurality of axially extending legs spaced apart around a periphery thereof that form a cage, with a plurality of the axially extending legs each including a latching element, which protrudes in a latching position into an inner circumference of the outer housing or the cage mount and which can be moved from the latching position into a zero position in a resiliently-elastic fashion, each of the latching elements comprises a latching protuberance (5) and in the zero position the at least one latching protuberance (5) is resiliently deflectable into a slot (6) in a respective latching element mount formed by a respective one of the axially extending legs located at a periphery of the installation housing or installation cage so that the at least one latching protuberance (5) enters into an outer circumference of the installation housing (2) or the installation cage, each of the slots is open at an axial end of the installation housing or installation cage and extends parallel to a longitudinal axis of thereof, and the installation part (1) can be inserted in the outer housing or the cage mount (2) without a latching groove (8) or a latching recess.

2. An installation part according to claim 1, wherein transverse edges of the latching protuberance (5) are rounded or beveled at both sides oriented transversely in reference to a mounting direction.

3. An installation part according to claim 1, wherein the slots (6) separate each of the respective axially extending legs from at least one spring arm (7) which carries a respective one of the at least one latching protuberance (5).

4. An installation part according to claim 1, wherein the latching protuberances in the latching position engage a latching groove (8) or a latching recess at a clear inner circumference of the outer housing or the cage mount.

5. An installation part according to claim 1, wherein each of the slots (6) has a slot width allowing a resilient deflection of the latching protuberance (5) into an outer circumference of the installation housing (2) or the installation cage.

6. An installation part according to claim 1, wherein the installation part comprises a backflow preventer (1) having a closing body (4) which is biased to a closed position via a spring (10).

7. An installation part according to claim 1, wherein the installation part can be inserted in the outer housing or the cage mount having a latching groove or a latching recess.

8. An installation part according to claim 1, wherein the latching element mounts are spaced apart peripherally and extend parallel to the longitudinal axis.

9. A sanitary installation part (1) comprising an installation housing (2) or installation cage, which can be mounted in an outer housing or a cage mount (3) of a gas or liquid line, the installation housing (2) includes a plurality of axially extending leas spaced apart around a periphery thereof that form a cage, with a plurality of the axially extending legs each including a latching element, which protrudes in a latching position into an inner circumference of the outer housing or the cage mount and which can be moved from the latching position into a zero position in a resiliently-elastic fashion, each of the latching elements comprises a latching protuberance (5) and in the zero position the at least one latching protuberance (5) is resiliently deflectable into a slot (6) in a respective latching element mount formed by a respective one of the axially extending legs located at a periphery of the installation housing or installation cage so that the at least one latching protuberance (5) enters into an outer circumference of the installation housing (2) or the installation cage, each of the slots is open at an axial end of the installation housing or installation cage and extends parallel to a longitudinal axis of thereof, and the installation part (1) can be inserted in the outer housing or the cage mount (3) such that the latching elements remains in the zero position.

10. A sanitary installation part (1) comprising an installation housing (2) or installation cage, which can be mounted in an outer housing or a cage mount (3) of a gas or liquid line, the installation housing (2) includes a plurality of axially extending legs spaced apart around a periphery thereof that form a cage, with a plurality of the axially extending legs each including a latching element, which protrudes in a latching position into an inner circumference of the outer housing or the cage mount and which can be moved from the latching position into a zero position in a resiliently-elastic fashion, each of the latching elements comprises a latching protuberance (5) and in the zero position the at least one latching protuberance (5) is resiliently deflectable into a slot (6) in a respective latching element mount formed by a respective one of the axially extending legs located at a periphery of the installation housing or installation cage so that the at least one latching protuberance (5) enters into an outer circumference of the installation housing (2) or the installation cage, each of the slots is open at an axial end of the installation housing or installation cage and extends parallel to a longitudinal axis of thereof, and the installation part (1) can be inserted into the outer housing or the cage mount (3) with one or the other face of the installation housing (2) or the installation cage inserted first.

* * * * *